United States Patent [19]

Van Craenenbroeck

[11] 4,345,715

[45] Aug. 24, 1982

[54] SAFETY DEVICE FOR A HEAT EXCHANGE EQUIPMENT FILLED WITH PRESSURIZED LIQUID

[76] Inventor: Raymond J. E. Van Craenenbroeck, Bergmolenstraat 64, B - 2740 Melsele, Belgium

[21] Appl. No.: 177,578

[22] Filed: Aug. 13, 1980

[30] Foreign Application Priority Data

Aug. 24, 1979 [BE] Belgium ..... 2/58027

[51] Int. Cl.[3] ..... F24D 3/10

[52] U.S. Cl. ..... 237/66; 137/207; 137/568; 165/104.27; 165/104.32; 165/DIG. 24

[58] Field of Search ..... 237/66; 138/26; 137/207, 209, 568; 165/104.27, 104.32, DIG. 24

[56] References Cited

FOREIGN PATENT DOCUMENTS 1811358 2/1971 Fed. Rep. of Germany .
2211983 10/1973 Fed. Rep. of Germany .
2301891 7/1974 Fed. Rep. of Germany .
2351924 4/1975 Fed. Rep. of Germany ..... 237/66
2711771 3/1977 Fed. Rep. of Germany .

*Primary Examiner*—Ronald C. Capossela
*Attorney, Agent, or Firm*—Stevens, Davis, Miller & Mosher

[57] ABSTRACT

A pipe connecting the equipment to be protected with a vessel is locally divided in two paths, a pump and a one-way valve being mounted in one path and an electro-magnetic valve in the other path. Pump and electric valve are controlled by a contact manometer so to fill or to empty the vessel depending on the pressure in the equipment.

The liquid body in the vessel moves a diaphragm between a position above the pipe connection but below a discharge opening and a position above this opening, in which latter position liquid is discharged through a siphon provided on the opening.

The diaphragm divides the vessel in two spaces and is the bottom of a bag secured to the vessel.

A float in a container connected to the vessel opens a feeding valve when the liquid level in this vessel is beneath a determined value.

12 Claims, 2 Drawing Figures

SAFETY DEVICE FOR A HEAT EXCHANGE EQUIPMENT FILLED WITH PRESSURIZED LIQUID

BACKGROUND OF THE INVENTION

This invention pertains to a safety device for a heat exchange equipment filled with pressurized liquid, particularly a central heating installation, which safety device comprises a liquid tank, a pipe connecting said tank to the equipment to be protected, which pipe is divided in one location at least into two paths, which safety device comprises in the divided portion location, in the one path, a pump which can pump the liquid from the tank to the equipment and in series with said pump, a one-way valve which only lets liquid flow to the equipment and, in the other path, thus shunting said pump and one-way valve, an electro-magnetic valve, which safety device further comprises a contact manometer which connects to that pipe portion which lies between the equipment and on the one hand the electro-magnetic valve in the one path and on the other hand the one-way valve in the other path, and which controls said pump and said electro-magnetic valve in such a way that when the pressure drops below a determined value, the pump starts operating and when the pressure rises above a determined value which is at least as high as the preceding value, the electromagnetic valve opens.

Such devices are notably used in central heating installations, mostly for balancing the water contraction and expansion due to temperature changes. Said safety devices are generally chosen rather than a safety device which only comprises an open tank which is mounted at the highest level of the heating installation. Said tank is not only located far away from the heating boiler proper which is cumbersome, but also the water inside the tank is continuously contacting air in such a way that oxygen can be absorbed which promotes the corrosion in the heating installation.

In known safety devices of the type concerned here, whereby thus a contact manometer, a pump and an electro-magnetic valve are provided, the tank is a pressurized closed tank. Inside said tank is present an amount pressurized nitrogen which is separated by a diaphragm from the water; said nitrogen is more or less pressurized depending on the water pressure. On said tank is mounted a safety valve for the case where the water pressure should rise too much, to let water escape from the tank. While such safety devices are very suitable in small heating installations, they are very expensive for very large heating installations, for example central heating installations in tower buildings or "skyscrapers". Not only does the tank then have to be of a very large size, but also it is then required to work with a very high pressure, with the result that both the tank and the heating installation have to be of heavy construction. When it is desired in such known safety devices, to provide for an automatic filling-up when the liquid level inside the installation is too low, this also requires a very intricate and consequently very expensive control device.

The invention has for object to obviate the above drawbacks and to provide a safety device of the above-defined type which has a very simple structure and thus does not require any expensive pressurized tank and whereby the automatic filling-up of liquid in the equipment can be insured in a very simple way.

THE INVENTION

For this purpose the liquid tank comprises a vessel to the bottom side of which connects the pipe, which vessel is provided in the side wall thereof above said connection with a discharge opening, which tank further comprises a diaphragm movable up-and-down by the liquid body inside said vessel and separating said vessel completely into a lowermost space and an uppermost space, said diaphragm being at least movable between a lowermost position whereby it lies above the pipe connection but below the discharge opening, and an uppermost position whereby it lies above the discharge opening and let liquid flow outwards through said discharge opening.

The lowermost space is continuously filled with liquid and even large volume changes of the liquid inside the installation can be balanced inside the vessel by means of the diaphragm displacement. The contact manometer operates thereby the pump or opens the electro-magnetic valve. In the case of a very large volume increase, the excess liquid can be discharged through said discharge opening in the vessel.

In a particular embodiment of the invention, the vessel communicates with the atmosphere above said uppermost diaphragm position.

In such an embodiment, substantially no counter-pressure is exerted on the diaphragm and said diaphragm moves only under the action of the liquid body. The atmosphere cannot however contact the liquid due to the diaphragm.

In a useful embodiment of the invention, a water seal is provided on the discharge opening in the vessel side wall.

In such an embodiment, the atmosphere cannot either contact through said discharge opening, the liquid inside the vessel.

In a remarkable embodiment of the invention, the safety device comprises a sensor which senses when the level inside the vessel drops below a pre-determined level and which so controls a liquid feeding valve that as long as the level inside the vessel is lower than said pre-determined level, said feeding valve is open and feeds liquid to the vessel.

In such an embodiment, the installation is automatically filled-up when it does contain too little liquid.

Usefully the sensor comprises a float which controls the feeding valve, which float is arranged inside a pipe which communicates below the pre-determined level with the vessel, and runs to above said level.

Preferably, said float opens and closes mechanically the feeding valve.

Other details and advantages of the invention will stand out from the following description of a safety device for a heat exchange equipment filled with pressurized liquid according to the invention; this description is only given by way of example and does not limit the invention; the reference numerals pertain to the accompanying drawings, in which:

DRAWINGS

In both figures, the same reference numerals pertain to similar elements.

DESCRIPTION OF A PREFERRED EMBODIMENT

Figure 1:
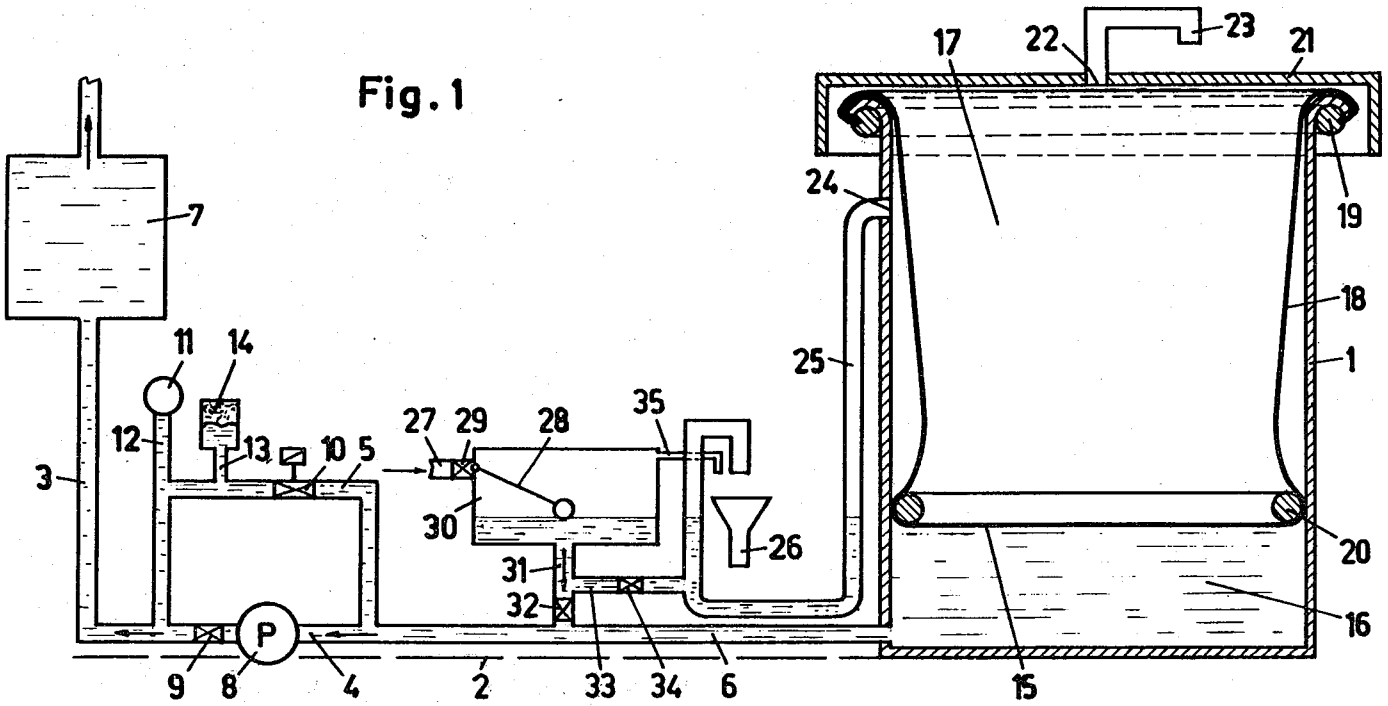
FIG. 1 is a diagrammatic cross-section of a safety device for a central heating installation according to the invention, whereby the device is shown during the filling-up of the installation.

The safety device as shown in the figures comprises a main pipe which on the one hand connects to the central heating installation, which has not been shown in the figures for the sake of clearness, and on the other hand connects to a vessel 1 which is arranged on the ground 2. Said main pipe comprises a first portion 3 on the side of the central heating installation, two paths 4 and 5 shunting one another which connect together at both ends thereof and connect on one side with the end thereof to said portion 3, and a portion 6 which connects the other joined ends from paths 4 and 5 to the lower side of vessel 1.

In said portion 3 from the main pipe is mounted a cooling tank 7 wherein water flowing from the central heating installation to the safety device, can be somewhat cooled in such a way that said safety device will not be damaged by the high temperature.

In said path 4 is mounted a pump 8 which is driven by an electric motor not shown in the drawings. Said pump 8 can only pump water in the direction from the portion 6 to the portion 3, that is thus from vessel 1 to said central heating installation. To prevent the liquid backflowing in the other direction, there has however been mounted in path 4, on the side of portion 3 relative to pump 8, a one-way valve 9 which only lets the water through in the above-defined direction, that is thus towards the heating installation.

An electric-magnetic valve 10 is mounted in main pipe path 5. Both said electro-magnetic valve 10 and pump 8, more particularly the electric motor thereof, are controlled by a contact manometer 11. Said contact manometer 11 is mounted on the end of an auxiliary pipe 12 which connects on the side of the heating installation, relative to said one-way valve 9 and electro-magnetic valve 10, to said main pipe. In the embodiment as shown in the figures, said auxiliary pipe 12 connects to path 4. Said contact manometer 11 closes for an adjustable lowermost pressure, the electric line in which the motor of said pump 8 is connected. For an adjustable higher pressure, said contact manometer 11 closes the electric line the electro-magnetic valve 10 is connected in, in such a way that said electro-magnetic valve will open.

Between said electric valve 10 and the connection of auxiliary pipe 12 to contact manometer 11, that is thus on the side of the heating installation to be protected relative to one-way valve 9 and electric valve 10, said path 5 communicates through an auxiliary pipe 13 with an expansion tank 14. Said expansion tank 14 is of a known type which is partly filled with nitrogen and inside which said nitrogen is separated from the liquid by a solid but resilient diaphragm. Said expansion tank 14 can balance a small volume change in the heating installation water in such a way that there does not appear directly thereby a large pressure change which would cause the contact manometer to operate or else would cause the pump 8 to operate or the electric valve 10 to open.

The above-described part of the safety device differs but little from the present devices. The structure of vessel 1 to the contrary is completely different. Said vessel is no closed pressurized vessel and thus no larger embodiment of expansion tank 14. Said vessel 1 is an open vessel which is divided by a vertically-movable diaphragm 15 into two completely separated spaces, namely a lowermost space 16 and an uppermost space 17 which communicates with the atmosphere.

Said diaphragm 15 is actually formed by the bottom from a bag 18 made of a flexible material such as rubber, which hangs inside vessel 1. The top edge of bag 18 is made fast to a ring 19 which fits below the top edge of vessel 1, which edge is folded outwards. Said ring 19 which is for example made from metal, sealingly presses said bag 18 against the wall of vessel 1 and thus separates completely the air and water media. By means of a second ring 20 which fits accurately inside vessel 1, the bottom of bag 18 is tightened. In the location of ring 20, said bag 18 is pressed against the inner wall of vessel 1 in such a way that the lowermost space 16 which lies below the bottom of bag 18 and thus below diaphragm 15, is sealingly separated from the top space 17 formed in said bag 18. The bag 18 is open at the top but to prevent the falling therein of dust and similar, said top side is closed together with the top side of vessel 1 by a cover 21 which bears simply loosely on said top side and is provided in the center thereof with an opening 22 to which connects a U-shaped air pipe 23. It is clear that the bottom of bag 18, that is diaphragm 15 can be moved up-and-down inside the vessel by that water which flows underneath in and out said vessel through portion 6 of the main pipe. Said bag has such a size that the diaphragm 15 formed by the bottom thereof in the lowermost position thereof still lies above the mouth of said portion 6 from the main pipe. The diaphragm 15 has been shown in such a position in FIG. 1. In the uppermost position of diaphragm 15 which has been shown in FIG. 2, the side walls of bag 18 are folded together. In such top position the diaphragm 15 lies precisely above a discharge opening 24 which is provided in the side wall of vessel 1. To this discharge opening 24 connects a water seal which is formed by a pipe 25 which comprises a portion that connects to opening 24 and runs downwards down to a short distance above ground 2, a portion connecting thereto which runs in parallel relationship with ground 2 and a third portion which runs back upwards to half the height of said first portion and the top end of which is bent in U-shape. Said latter end opens on a discharge pipe 26. Said pipe 25 thus forms actually a siphon which is partly filled with water in such a way that even along pipe 25 no air can enter the water inside lowermost space 16. By the first rising of diaphragm 15 up to discharge opening 24, the air which was present in the small space between the wall of said bag 18 and the inner wall of vessel 1 disappears substantially completely.

The safety device further comprises a device for automatically filling-up the heating installation when said installation contains too little water. Said filling-up device comprises a water feeding pipe 27 which connects to the distribution network and which ends on a valve 29 which is controlled mechanically by a sensor, float, 28. Said valve 29 is mounted on a container 30 wherein is arranged said float 28 and which is provided with an overflow 35. Said container 30 is arranged some distance above ground 2 next to vessel 1. The other side of container 30 connects through a pipe 31 to portion 6 of the main pipe. In said pipe 31 is mounted a one-way valve 32 which only lets the water through from container 30 to portion 6 and not in the reverse direction.

A horizontally-running connecting pipe 33 connects on the one hand between container 30 and one-way valve 32, to pipe 31 and on the other hand to that portion running upwards of pipe 25. In said connecting pipe is mounted a one-way valve 34 which lets the liquid flow but in the direction from pipe 31 to pipe 25.

The working of the above-described safety device is as follows:

When the volume lowering of the water inside the heating installation due either to contraction resulting from cooling or to leaking, can no more be balanced by the small amount of water inside the expansion tank 14, the pressure inside the central heating installation and thus also in portion 3 of the main pipe will drop strongly. The contact manometer 11 measures said dropping pressure and when the pressure lies below the lowermost determined value, said manometer 11 orders pump 8 to start operating. Said pump then pumps water from vessel 1 through the main pipe to the heating installation until the pressure has risen above said value, that is the manometer 11 no longer causes the pump 8 to operate. Due to water being pumped out of vessel 1, the diaphragm 15 drops for example down to the position shown in FIG. 1. As soon as the level inside vessel 1 lies lower than the water level inside container 30, the pump 8 will also pump water away from said container 30 through pipe 31. The level inside container 30 thus drops in the same proportion as the level inside vessel 1. The float 28 will drop down and when it is low enough, said float will open valve 29. Water will now be fed automatically from water feeding pipe 27. Valve 29 and pipe 27 are so designed that there is at least as much water added as the pump 8 can pump to the heating installation. The water level will thus no more drop.

In FIG. 1, the safety device has been shown during the filling-up. The water flow direction has been shown with arrows in this figure. Due to the connecting pipe 33 the water in pipe 25 will always remain at the same level as inside container 30.

When the pressure inside the heating installation has risen back enough, the manometer 11 will stop the pump.

When now to the contrary, the expansion of the water inside the heating installation is so large that it can no more be balanced by the expansion tank 14, the pressure inside the installation will rise to such a value that manometer 11 will open the electric valve 10. Part of the liquid can now flow through portion 3, path 5 and portion 6 to vessel 1 where said liquid will push diaphragm 15 upwards. With a very large expansion, said diaphragm 15 can rise to above the discharge opening, in such a way that the excess water can flow away through said discharge opening 24 and pipe 125 connecting thereto, to discharge pipe 26. The water discharged through pipe 25 does not influence the level inside container 30 as the one-way valve 34 does not let any water flow to said container 30 through connecting pipe 33.

Figure 2:
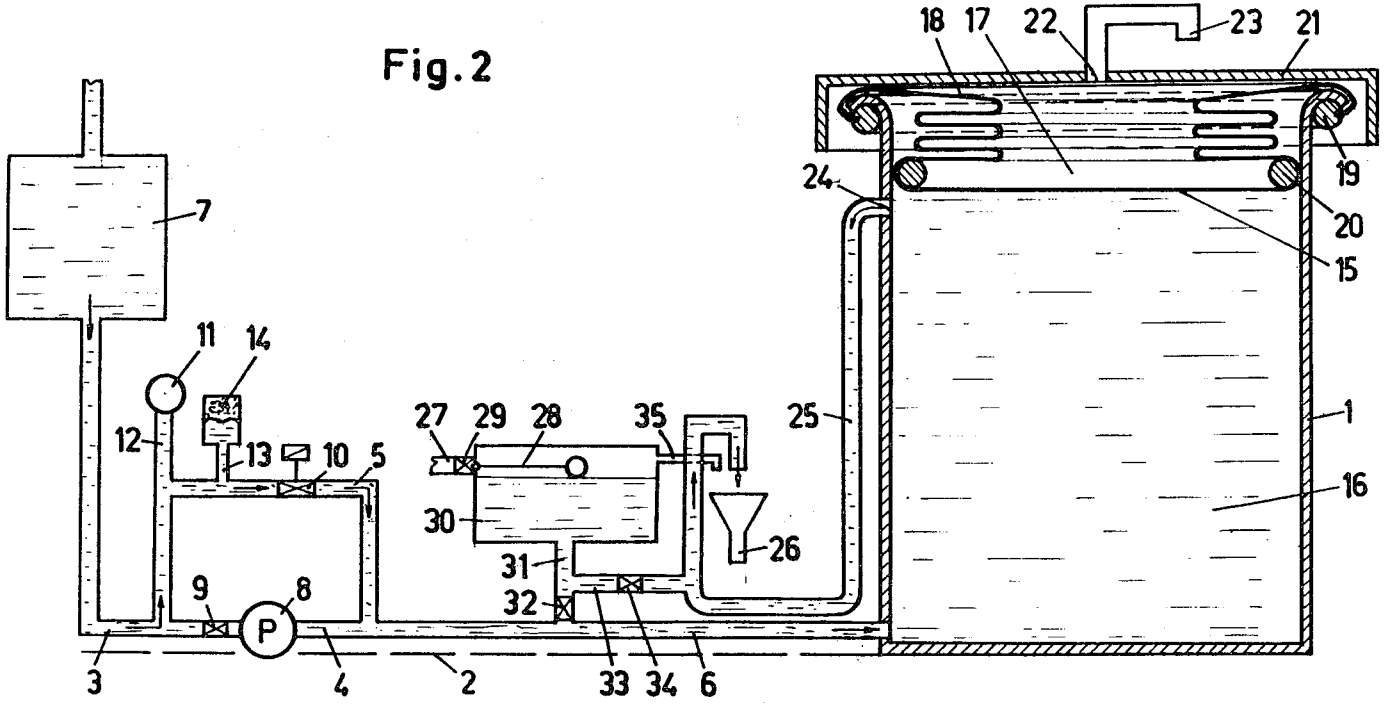
FIG. 2 is a cross-section similar to the one in FIG. 1 of the safety device shown in said FIG. 1 but whereby the device is shown during the installation overflow.

In FIG. 2, the safety device has been shown in the position where excess water is discharged from vessel 1. The water flow direction is shown with arrows.

The above-described device has not only a very simple structure and is relatively unexpensive, but it is also completely safe as any water shortage is automatically filled-up. The water inside vessel 1 does not contact the atmosphere, in such a way that the oxygen absorption in the water and consequently the installation corroding is limited. In spite thereof, the vessel does not have necessarily to be located at the highest level of the heating installation. The vessel may be arranged anywhere and for example be mounted next to the heating boiler.

The safety device does not have necessarily to comprise a cooling tank and/or an expansion tank. The valve or cock on the water feeding pipe should not necessarily either be controlled by a float.

The safety device is also not exclusively intended for heating installations. It may for instance also be used in cooling equipment or other equipments wherein water volume changes have to be taken into account.

That pressure value below which the contact manometer causes the pump to operate should not necessarily be different from that pressure value above which said contact manometer opens the electric valve. There is the possibility also to have said contact manometer order the pump stopping when the pressure has risen above a higher value than the one which is adjusted for the pump to start operating. In the same way, the contact manometer can order the electric valve to close when the pressure has dropped below a determined value which is lower than the adjusted value whereby with a rising pressure, said manometer opens the electric valve. In any case there should be avoided that the pump operates and the electric valve is open at the same time.

I claim:

1. A safety device for heat exchange equipment fillable with pressurized liquid, which safety device comprises:

a. a vessel with sidewalls having an overflow for discharging liquid from said vessel when the liquid rises above the level of said overflow, b. a diaphragm mounted in said vessel movable by the liquid inside said vessel between a position below the overflow and a position above said overflow to separate said vessel into a lower and an upper space, said upper space being open to the atmosphere, c. a pipe for connecting the lower space of the vessel to the equipment to be protected, which pipe is divided in one location into two paths which paths subsequently join before reaching the equipment, d. a pump with its pressure side directed toward the equipment in one path, e. a one-way valve through which liquid flows to the equipment, in the same path and thus in series with said pump, f. an electro-magnetic valve in the other path, g. a contact manometer connected to said other path between the equipment and the electro-magnetic valve, and h. means for controlling said pump and said electromagnetic valve based on the pressure measured by the manometer.

2. The safety device as defined in claim 1, including a top for said vessel having an opening therein connecting said upper space with the atmosphere.

3. The safety device as defined in claim 1, including a water seal which is mounted on the overflow.

4. The safety device as defined in claim 3, wherein said overflow is positioned in the upper part of the vessel side wall and the water seal comprises a pipe which has a portion connecting to the overflow which extends down, and an upright portion which extends upwards to a height which is lower than said overflow.

5. The safety device as defined in claim 1, including a liquid feeding pipe communicating with the pipe connected to the lower space of the vessel between the space and the pump, a valve in the feeding pipe and a sensor detecting the dropping of the level in the vessel below a pre-determined level and controlling said valve.

6. The safety device as defined in claim 5, including a container in which the sensor is mounted and to which is connected the feeding pipe, an auxiliary pipe connected to the lowermost part of said container and to the pipe connected to the lower space of the vessel between the space and the pump, and a one-way valve in the auxiliary pipe through which liquid flows from the container to said pipe connected to the lower space of said vessel.

7. The safety device as defined in claim 6, wherein said sensor comprises a float mounted in said container and mechanically connected to the feeding valve.

8. The safety device as defined in claim 6, including a water seal mounted on the overflow having a lower part positioned lower than level of the liquid in the vessel, a connecting pipe between the lowermost part of the container and the lower part of the water seal, and a one-way valve positioned in said connecting pipe to permit liquid flow from the container to the water seal.

9. The safety device as defined in claim 1, including a bag from flexible material inside said vessel, having an edge and bottom, said bag being made fast with its edge to said vessel and having its bottom float on the liquid in the vessel to form the up-and-down movable diaphragm and fitting close to the vessel inner wall.

10. The safety device as defined in claim 9, including a ring arranged inside said flexible bag to retain the bag bottom somewhat stressed and cause said bottom to fit close to the vessel inner wall.

11. The safety device as defined in claim 1, including a cooling tank which is mounted between the heat exchange equipment on the one hand and the pump and the electro-magnetic valve on the other hand.

12. The safety device as defined in claim 1, including an expansion tank mounted between the heat exchange equipment on the one hand, and the pump, and the electro-magnetic valve on the other hand.

* * * * *